US007531279B2

(12) United States Patent
Watanabe et al.

(10) Patent No.: US 7,531,279 B2
(45) Date of Patent: May 12, 2009

(54) TONER MANUFACTURING METHOD, TONER AND DEVELOPER

(75) Inventors: Naohiro Watanabe, Suntou-Gun (JP); Shigeru Emoto, Numazu (JP); Chiaki Tanaka, Izunokuni (JP); Masahide Yamada, Numazu (JP); Akinori Saitoh, Numazu (JP); Masahiro Ohki, Numazu (JP); Ryota Inoue, Mishima (JP)

(73) Assignee: Ricoh Company Limited, Tokyo (JP)

( * ) Notice: Subject to any disclaimer, the term of this patent is extended or adjusted under 35 U.S.C. 154(b) by 321 days.

(21) Appl. No.: 11/430,171

(22) Filed: May 9, 2006

(65) Prior Publication Data

US 2006/0251979 A1 Nov. 9, 2006

(30) Foreign Application Priority Data

May 9, 2005 (JP) ..... 2005-136073

(51) Int. Cl.
*G03G 9/08* (2006.01)

(52) U.S. Cl. ..... 430/108.6; 430/111.4; 430/137.14

(58) Field of Classification Search ..... 430/108.6, 430/108.1, 137.14, 111.4
See application file for complete search history.

(56) References Cited

U.S. PATENT DOCUMENTS

| | | | | |
|---|---|---|---|---|
| 3,666,363 | A | 5/1972 | Tamaka et al. | |
| 4,071,361 | A | 1/1978 | Marushima | |
| 5,747,210 | A | 5/1998 | Emoto et al. | |
| 6,221,549 | B1 | 4/2001 | Emoto et al. | |
| 6,395,443 | B2 | 5/2002 | Kuroda et al. | |
| 6,660,443 | B2 | 12/2003 | Sutiyama et al. | |
| 6,682,866 | B2 | 1/2004 | Sugiyama et al. | |
| 6,740,460 | B2 | 5/2004 | Tomita et al. | |
| 6,756,175 | B2 | 6/2004 | Emoto et al. | |
| 6,787,280 | B2 | 9/2004 | Yamashita et al. | |
| 6,800,412 | B2 | 10/2004 | Sugiyama et al. | |
| 6,824,945 | B2 | 11/2004 | Emoto et al. | |
| 6,835,519 | B2 | 12/2004 | Sugiyama et al. | |
| 6,846,604 | B2 | 1/2005 | Emoto et al. | |
| 6,849,369 | B2 | 2/2005 | Yagi et al. | |
| 6,852,462 | B2 | 2/2005 | Emoto et al. | |
| 6,853,822 | B2 | 2/2005 | Yano et al. | |
| 6,936,390 | B2 | 8/2005 | Nanya et al. | |
| 7,005,223 | B2 | 2/2006 | Yamashita et al. | |
| 2003/0027066 | A1 | 2/2003 | Yamashita et al. | |
| 2003/0096185 | A1 | 5/2003 | Yamashita et al. | |
| 2004/0053154 | A1 | 3/2004 | Tomita et al. | |
| 2005/0042534 | A1* | 2/2005 | Tanaka et al. | 430/108.4 |
| 2005/0164114 | A1* | 7/2005 | Yagi et al. | 430/110.1 |

FOREIGN PATENT DOCUMENTS

| | | | |
|---|---|---|---|
| EP | 1 045 292 | A1 | 10/2000 |
| EP | 1 205 811 | A2 | 5/2002 |
| EP | 1 225 600 | A2 | 7/2002 |
| EP | 1 491 968 | A1 | 12/2004 |
| JP | 03-002276 | | 1/1991 |
| JP | 05-088412 | | 4/1993 |
| JP | 05-249742 | | 9/1993 |
| JP | 06-019204 | | 1/1994 |
| JP | 11-157843 | | 6/1999 |
| JP | 11-189420 | | 7/1999 |
| JP | 2000-319021 | | 11/2000 |
| JP | 2002-129063 | | 5/2002 |
| JP | 2002-189313 | | 7/2002 |
| JP | 2002-196528 | | 7/2002 |

OTHER PUBLICATIONS

U.S. Appl. No. 11/676,883, filed Feb. 20, 2007, Tanaka.
U.S. Appl. No. 11/687,075, filed Mar. 16, 2007, Yamada et al.
U.S. Appl. No. 11/685,872, filed Mar. 14, 2007, Uchinokura et al.
U.S. Appl. No. 11/687,372, filed Mar. 16, 2007, Yamada et al.
U.S. Appl. No. 11/226,357, filed Sep. 15, 2005, Tanaka et al.
U.S. Appl. No. 11/206,128, filed Aug. 18, 2005, Yamashita et al.
U.S. Appl. No. 12/040,451, filed Feb. 29, 2008, Saitoh et al.
U.S. Appl. No. 11/685,969, filed Mar. 14, 2007, Uchinokura et al.
U.S. Appl. No. 11/734,895, filed Apr. 13, 2007, Yamashita et al.
U.S. Appl. No. 12/042,041, filed Mar. 4, 2008, Yamada et al.
U.S. Appl. No. 12/046,011, filed Mar. 11, 2008, Nagatomo et al.
U.S. Appl. No. 11/852,778, filed Sep. 10, 2007, Nagatomo et al.
U.S. Appl. No. 11/855,806, filed Sep. 14, 2007, Awamura et al.
U.S. Appl. No. 11/856,379, filed Sep. 17, 2007, Sawada et al.
U.S. Appl. No. 11/857,791, filed Sep. 19, 2007, Kojima et al.
U.S. Appl. No. 12/203,278, filed Sep. 3, 2008, Yamada et al.
U.S. Appl. No. 12/209,583, filed Sep. 12, 2008, Seshita et al.

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner manufacturing method is provided including emulsion-polymerizing monomers including an aromatic vinyl monomer, to prepare a particulate resin dispersion; mixing the particulate resin dispersion and a colorant dispersion including a black metallic material, to prepare an aggregation dispersion including aggregated resin particles including the colorant therein; heating the aggregation dispersion to a temperature of not less than a glass transition temperature of the particulate resin to unite each of the aggregated particles to prepare a toner dispersion; and washing the toner dispersion to obtain the toner; a toner manufactured by the above method, and a developer using the toner.

16 Claims, No Drawings

TONER MANUFACTURING METHOD, TONER AND DEVELOPER

BACKGROUND OF THE INVENTION

1. Field of the Invention

The present invention relates to a toner manufacturing method. In addition, the present invention relates to a toner and a developer including the toner for use in an electrophotographic image forming apparatus.

2. Discussion of the Background

U.S Pat. No. (hereinafter referred to as USP) U.S. Pat. No. 2,297,691, published examined Japanese patent applications Nos. (hereinafter referred to as JP-B) 42-23910 and 43-24748, etc. have disclosed various kinds of image forming methods using electrophotography. Typically, in electrophotography, an image is formed as follows:

(1) an electrostatic latent image is formed on an image bearing member (such as a photoreceptor including a photoconductive material);

(2) the electrostatic latent image is developed with a developer including a toner to form a toner image on the image bearing member;

(3) the toner image is transferred onto a recording material (such as a paper); and (4) the toner is fixed on the recording material by application of heat, pressure or solvent vapors.

A full color image is typically formed by overlaying black, yellow, magenta and cyan toner images.

Carbon blacks are typically used as colorants for black toners. Recently, attempts to use particulate black metallic compounds as black colorants instead of carbon blacks have been made.

Japanese patent No. (herein after referred to as JP) 2736680 discloses a particulate black colorant having an average diameter of from 0.1 to 0.5 μm, and including a mixture of a $Fe_2TiO_5$ and a solid solution of $Fe_2O_3$—FeTiO.

JPs 3101782, 3108823 and 3174960 have disclosed black toners including a particulate magnetic iron oxide including FeO in an amount of from 25 to 30% by weight.

JPs 3224774 and 3261088 have disclosed particulate magnetites having a residual magnetization of not greater than 6 emu/g.

Published unexamined Japanese patent application No. (hereinafter referred to as JP-A) 2000-319021 discloses a particulate iron oxide including titanium therein.

JP-A 2002-129063 discloses a black colorant including a mixed phase crystal of rutile type titaniumdioxide ($TiO_2$) covered by an iron titanium spinel ($Fe_2TiO_4$), and having a saturated magnetization of from 0.5 to 10 emu/g and a particle diameter of from 0.1 to 0.4 μm.

JP-A 2002-189313 discloses a black toner having a dielectric loss factor of not larger than 50, which includes a particulate metallic compound having a saturated magnetization of not greater than 30 emu/g.

JP-A 2002-196528 discloses a black toner including a particulate metallic compound having a saturated magnetization of not greater than 40 emu/g, in an amount of not greater than 20% by weight.

In terms of safety and fluidity of colorants, metallic compounds have an advantage over carbon blacks. In addition, a toner including metallic compounds has higher thermal conductivity than that including carbon blacks, i.e., the toner has good low-temperature fixability. Moreover, since metallic compounds have a higher specific gravity than carbon blacks, a toner including a metallic compound can be easily mixed with a carrier in a two-component developer. However, there has been a problem in that metallic compounds cannot be well dispersed in pulverization toners.

SUMMARY OF THE INVENTION

Accordingly, an object of the present invention is to provide a toner manufacturing method which can produce a toner in which a metallic compound colorant is well dispersed.

Another object of the present invention is to provide a toner having a good combination of safety, coloring power, low temperature fixability and chargeability.

Another object of the present invention is to provide a developer which can produce high definition images with little background fouling and little toner scattering.

These and other objects of the present invention, either individually or in combinations thereof, as hereinafter will become more readily apparent can be attained by a toner manufacturing method, comprising:

emulsion-polymerizing monomers comprising an aromatic vinyl monomer, to prepare a particulate resin dispersion;

mixing the particulate resin dispersion and a colorant dispersion comprising a black metallic material, to prepare an aggregation dispersion comprising aggregated resin particles including the colorant therein;

heating the aggregation dispersion to a temperature of not less than a glass transition temperature of the particulate resin to unite each of the aggregated particles to prepare a toner dispersion; and washing the toner dispersion to obtain the toner.

In addition, the present invention provides a toner manufactured by the above method, and a developer using the toner.

DETAILED DESCRIPTION OF THE INVENTION

Black Metallic Material

The toner of the present invention includes a black metallic material as a colorant. Such a toner has no need to include carbon black. Because carbon blacks have high electrical conductivity, a toner including a carbon black typically has low resistance and poor charge retention property. Therefore, reversely or weakly charged toner particles are easily produced, resulting in production of abnormal images having background fouling, and occurrence of toner scattering. The toner of the present invention including the black metallic material does not have such drawbacks.

Specific examples of the black metallic materials include compounds and oxides containing one or more elements selected from the group consisting of manganese (Mn), titanium (Ti), copper (Cu), silicon (Si) and carbon (C); and mixtures including one or more compounds or oxides selected therefrom.

The black metallic material for use in the toner of the present invention preferably has a saturated magnetization of from 0 to 50 emu/g. The saturated magnetization includes all values and subvalues therebetween, particularly including 5, 10, 15, 20, 25, 30, 35, 40 and 45 emu/g. In this case, the resultant toner has a weak magnetic force and does not strongly adhere to a developer bearing member (when the toner is used in a one-component developer) or a carrier (when the toner is used in a two-component developer). As a result, developability of the toner does not deteriorate.

The blackness of the black metallic material can be determined using the L*, a* and b* values of the CIE 1976 L*a*b* color space. The black metallic material for use in the toner of the present invention preferably has an L* value of not larger than 20, more preferably from 9 to 15, an a* value of from −1.0 to +1.0, and a b* value of from −1.0 to +1.0. The L* value includes all values and subvalues therebetween, particularly including 10, 11, 12, 13, 14, 15, 16, 17, 18 and 19. The a* and b* values respectively include all values and subvalues therebetween, particularly including −0.8, −0.6, −0.4, −0.2, 0, 0.2, 0.4, 0.6 and 0.8. By using such black metallic materials, the resultant toner can produce images having high image density.

Among various kinds of black metallic materials, titanium-containing iron oxides are preferably used in the toner of the present invention. This is because the titanium-containing iron oxides do not use chemical substances which have to be registered according to PRTR (Pollutant Release and Transfer Register). Among various kinds of titanium-containing iron oxides, particulate polycrystals including a solid solution of $Fe_2O_3$—$FeTiO_3$ are preferably used because such compounds have black color and no magnetic properties.

The compound preferably contains titanium atoms (Ti) in amount of from 10 to 45% by weight based on iron atoms (Fe). The amount of Ti includes all values and subvalues therebetween, particularly including 15, 20, 25, 30, 35 and 40%. When the amount of Ti is too small, the compound has a magnetization that is too high. In contrast, when the amount of Ti is too large, the compound has no magnetization, but has an L* value that is too high, due to inclusion of a large amount of $TiO_2$.

The black metallic material for use in the present invention preferably has a specific surface area of from 1.3 to 80 $m^2/g$, and more preferably from 1.5 to 30 $m^2/g$. The specific surface area includes all values and subvalues therebetween, particularly including 1.5, 2, 5, 10, 15, 20, 25, 30, 35, 40, 45, 50, 55, 60, 65, 70 and 75 $m^2/g$. When the specific surface area is too large, the metallic material serves as a filler and tends to inhibit low temperature fixing of the resultant toner. When the specific surface area is too small, the coloring power of the resultant toner is too low.

The black metallic material for use in the present invention preferably has a true specific gravity of from 4.0 to 5.0 $cm^2/g$. The true specific gravity includes all values and subvalues therebetween, particularly including 4.1, 4.2, 4.3, 4.4, 4.5, 4.6, 4.7, 4.8 and 4.9 $cm^2/g$. In this case, the true specific gravity of the resultant toner is close to that of a carrier, therefore such a toner can be efficiently mixed with the carrier.

The toner of the present invention preferably includes the black metallic material in an amount of from 10 to 50% by weight, and more preferably from 15 to 25% by weight, based on the total weight of the toner. The amount of the black metallic material includes all values and subvalues therebetween, particularly including 15, 20, 25, 30, 35, 40 and 45% by weight. When the amount is too small, low-temperature fixability and coloring power of the toner deteriorates. When the amount is too large, the black metallic material cannot be well dispersed in the toner, resulting in deterioration of chargeability, developability and fixability of the toner.

The black metallic material for use in the present invention preferably has a number average primary particle diameter of from 0.05 to 2.0 μm, and more preferably from 0.1 to 0.5 μm from the viewpoint of dispersibility in the toner. The number average primary particle diameter includes all values and subvalues therebetween, particularly including 0.1, 0.2, 0.3, 0.4, 0.5, 0.6, 0.7, 0.8, 0.9, 1.0, 1.1, 1.2, 1.3, 1.4, 1.5, 1.6, 1.7, 1.8 and 1.9 μm.

The black metallic material for use in the present invention can be prepared by the following method:

(1) A particulate reduction product is prepared by reducing a raw material such as (1) a particulate magnetite covered with a titanium compound, or (2) a mixture of a particulate magnetite and a titanium compound, or (3) a particulate hematite covered with a titanium compound; and (2) The particulate reduction product is heated to not less than 700° C. to be calcined under non-oxidizing atmosphere followed by pulverization.

The particulate magnetite covered with a titanium compound is preferably used as the raw material, because the product has low magnetization.

The particulate magnetite and particulate hematite may have shapes such as grain, sphere, acicula, etc. but are not limited thereto. These particulate materials (i.e., raw materials) preferably have a particle diameter of from 0.03 to 1.5 μm. The size of the product (i.e., the black metallic material) has a correlation with that of the raw material. When the raw material is small, the product tends to be small. When the raw material is large, the product tends to be large.

Specific examples of the titanium compounds include hydrated oxides, hydroxides and oxides, containing titanium. When the titanium compound is mixed with the particulate magnetite, soluble titanium compounds are preferably used. The product contains titanium atoms (Ti) in an amount of from 10 to 45% by weight based on iron atoms (Fe). The amount of Ti includes all values and subvalues therebetween, particularly including 15, 20, 25, 30, 35 and 40% by weight. When the amount of Ti is too small, the compounds have a magnetization that is too high. In contrast, when the amount of Ti is too large, the compounds have no magnetization, but have an L* value that is too high because of including a large amount of $TiO_2$.

Specific examples of the non-oxidizing atmosphere include $N_2$ (nitrogen) gas. When an oxidizing atmosphere is used, the target black iron oxide cannot be obtained.

The calcination temperature is not less than 700° C. When the calcination temperature is too low, a solid-phase reaction between the iron oxide and the titanium compound does not occur to a sufficient degree, and therefore the target black iron oxide cannot be obtained.

Known pulverizers such as ball mills, attriters, vibration mills, and the like can be used for pulverization.

The raw material can be covered with a known sintering inhibitor before being subjected to the calcination, if desired. In this case, the occurrence of sintering between the particles can be prevented, and therefore the target black iron oxide having good dispersibility can be obtained.

Specific examples of the sintering inhibitors in which various properties of the black metallic material do not deteriorate include compounds containing one or more elements selected from the group consisting of aluminum (Al), titanium (Ti), silicon (Si), zirconium (Zr) and phosphorus (P). The black metallic material preferably includes these elements contained in the sintering inhibitor in an amount of from 0.1 to 15.0% by atom based on iron (Fe) and titanium (Ti). The amount of these elements includes all values and subvalues therebetween, particularly including 0.5, 1, 2, 3, 4, 5, 6, 7, 8, 9, 10, 11, 12, 13 and 14% by atom. When the amount is too small, the occurrence of sintering cannot be sufficiently prevented. When the amount is too large, the resultant particulate black metallic material includes unreacted magnetites having magnetic force.

To enhance blackness of the black metallic material, one or more black dyes and/or pigments or one or more blue dyes and/or pigments are preferably fixed to the surface of the black metallic material using MECHANOMILL (from Okada Seiko Co., Ltd.) or MECHANOFUSION® (from Hosokawa Micron Ltd.). Specific examples of the black dyes and pigments include iron black, aniline black, graphite, fullurene, etc. Specific examples of the blue dyes and pigments include cobalt blue, Alkali Blue, Victoria Blue Lake, Phthalocyanine Blue, Metal-free Phthalocyanine Blue, partially chloride of Phthalocyanine Blue, Fast Sky Blue, INDANTHRENE BLUE BC, etc. These can be used alone or in combination, but are not limited thereto.

Resin

The resin for use in the toner of the present invention is formed by polymerization of monomers. The monomers preferably include at least one aromatic vinyl monomer containing at least one aromatic ring. The monomers preferably include the aromatic vinyl monomer in an amount of not less than 50% by weight based on total weight of the monomers.

Specific examples of the aromatic vinyl monomers include styrenes and alkylstyrenes (e.g., styrene, α-methylstyrene, trans-β-methylstyrene, p-methylstyrene, p-tert-butylstyrene, etc.); alkoxystyrenes (e.g., 4-methoxystyrene, 3,4-dimethoxystyrene, p-tert-butoxystyrene, etc.); halogen-substituted styrenes (e.g., β-chlorostyrene, β-bromostyrene, p-chlorostyrene, p-bromostyrene, p-fluorostyrene, 4-fluoro-α-methylstyrene, etc.); nitrogen-containing aromatic compounds and their ester compounds (e.g., p-nitrostyrene, 2-vinylpyridine, etc.);metal salts of styrenes containing sulfonic acid group (e.g., sodium p-styrene sulfonate, potassiump-styrene sulfonate, etc.); and vinyl benzoate, vinyl cinnamate, vinyl naphthalene, etc.

In addition, the resin for use in the toner of the present invention can be formed by copolymerization of the above-mentioned aromatic vinyl monomers and other monomers.

Specific examples of the other monomers include esters containing a vinyl group (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, etc.); vinyl nitriles (e.g., acrylonitrile, methacrylonitirile, etc.); vinyl ethers (e.g., vinyl methyl ether, vinyl isobutyl ether, etc.); vinyl ketones (e.g., vinyl methyl ketone, vinyl ethyl ketone, vinyl isopropenyl ketone, etc.); and olefins (e.g., ethylene, propylene, butadiene, isoprene, etc.). These can be used alone or in combination.

In the present invention, these monomers can be polymerized using a cross-linking agent, if desired.

Specific examples of the cross-linking agents include aromatic polyvinyl compounds (e.g., divinylbenzene, divinylnaphthalene, etc.), polyvinyl esters of aromatic polycarboxylic acids (e.g., divinyl phthalate, divinyl isophthalate, divinyl terephthalate, divinyl homophthalate, trimesic acid divinyl ester, trimesic acid trivinyl ester, divinyl naphthalenedicarboxylate, divinyl biphenylcarboxylate, etc.); divinyl esters of nitrogen-containing aromatic compounds (e.g., divinyl pyridinedicarboxylate, etc.); unsaturated heterocyclic compounds (e.g., pyrrole, thiophene, etc.); vinyl esters of heterocyclic carboxylic acid (e.g., vinyl furoate, vinyl pyrrole-2-carboxylate, vinyl thiophenecarboxylic acid, etc.); esters of straight-chain polyalcohol and (meth)acrylic acid (e.g., butanediol methacrylate, hexanediol acrylate, octanediol methacrylate, decanediol acrylate, dodecanediol methacrylate, etc.); esters of branched or substituted polyalcohol and (meth)acrylic acid (e.g., neopentyl glycol dimethacrylate, 2-hydroxy-1,3-diacryloxypropane, etc.); esters of polypropylene/polyethylene glycol and (meth) acrylic acid (e.g., polyethylene glycol di(meth)acrylate, etc.); and polyvinyl esters of polycarboxylic acids (e.g., divinyl succinate, divinyl fumarate, vinyl/divinyl maleate, divinyl diglycoate, vinyl/divinyl itaconate, divinyl acetonedicarboxylate, divinyl glutarate, divinyl 3,3'-thiopropionate, divinyl/trivinyl trans-aconitate, divinyl adipate, divinyl pimelate, divinyl suberate, divinyl azelate, divinyl sebacate, divinyl dodecanoate, brassyl acid divinyl ester, etc.) These can be used alone or in combination.

The resin for use in the toner of the present invention can be formed by a radical polymerization of monomers.

All known radical polymerization initiators capable of emulsion polymerization can be used, and are not particularly limited. Specific examples of the radical polymerization initiators include peroxides (e.g., hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropylperoxycarbonate, teralinhydroperoxide, 1-phenyl-2-methylpropyl-1-hydroperoxide, tert-butyl hydroperoxide pertriphenylacetate, tert-butyl performate, tert-butyl peracetate, tert-butyl perbenzoate, tert-butyl perphenylacetate, tert-butyl permethoxyacetate, etc.); azo compounds (e.g., 2,2'-azobispropane, 2,2'-dichloro-2,2'-azobispropane, 1,1'-azo(methylethyl)diacetate, 2,2'-azobis(2-aminodipropane) hydrochloride, 2,2'-azobis(2-aminodipropane) nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methyl-butyronitrile, dimethyl 2,2'-azobisisobutyrate, 1,1'-azobis(1-methylbutyronitrile-3-sodium sulfate), 2-(4-methyphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4'-azobis-4-cyanopentanoate), poly(tetraethylene glycol-2,2'-azobisisobutylate), etc.); and 1,4-bis(pentaethylene)-2-tetrazene, 1,4-dimethoxycarbonyl-1,4-diphenyl-2-tetrazene, etc.

Release Agent

The toner of the present invention can include a release agent.

Specific examples of the release agents include polyolef in waxes (e.g., polyethylene wax, polypropylene wax, etc.); long-chain hydrocarbons (e.g., paraffin wax, SASOL wax, etc.); and waxes containing a carbonyl group. Among these, the waxes containing a carbonyl group are preferably used.

Specific examples of the waxes containing a carbonyl group include esters of polyalkanoic acid (e.g., carnauba wax, montan wax, trimethylolpropane tribehenate, pentaerythritol tetrabehenate, pentaerythritol diacetate dibehenate, glycerine tribehenate, 1,18-octadecanediol distearate, etc.); polyalkanol esters (e.g., tristearyl trimelliate, distearyl maleate, etc.); polyalkanoicacidamides (e.g., ethylenediamine dibehenyl amide, etc.); polyalkylamides (e.g., trimellitic acid tristearylamide, etc.); and dialkyl ketones (e.g., distearyl ketone, etc.). Among these waxes containing a carbonyl group, esters of polyalkanoic acid are preferably used. These can be used alone or in combination.

The release agent for use in the toner of the present invention has a melting point of from 40 to 160° C., preferably from 50 to 120° C., and more preferably from 60 to 90° C. The melting point includes all values and subvalues therebetween, particularly including 50, 60, 70, 80, 90, 100, 110, 120, 130, 140 and 150° C. When the melting point is too low, the thermostable preservability of the resultant toner deteriorates. When the melting point is too high, cold offset tends to be caused in low-temperature fixing.

The release agent for use in the toner of the present invention preferably has a viscosity of from 5 to 1000 cps, and more preferably from 10 to 100 cps, at a temperature of 20° C. higher than the melting point thereof. The viscosity includes all values and subvalues therebetweeen, particularly including 10, 50, 100, 200, 400, 600 and 800 cps. When the viscosity is too high, hot offset resistance and low temperature fixability of the resultant toner deteriorates.

The toner of the present invention preferably includes the release agent in an amount of from 0 to 40% by weight, and more preferably from 3 to 30% by weight. The amount of the release agent includes all values and subvalues therebetween, particularly including 1, 2, 3, 4, 5, 10, 15, 20, 25, 30 and 35% by weight.

Charge Controlling Agent

The toner of the present invention can optionally include a charge controlling agent. All known charge control agents can be used. However, since colored materials influence the color tone of the images produced, colorless or white materials are preferably used.

Specific examples of the charge controlling agents include triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc. These can be used alone or in combination.

Specific examples of marketed products of the charge controlling agents include BONTRON® P-51 (quaternary ammonium salt), BONTRON® E-82 (metal complex of oxynaphthoic acid), BONTRON® BONTRON® E-84 (metal complex of salicylic acid) and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; and quinacridone, azo pigments and polymers having a functional groupsuchas sulfonate group, a carboxyl group, a quaternary ammonium group, etc.

The content of the charge controlling agent is determined depending on the species of the binder resin used, and toner manufacturing method used, and is not particularly limited. However, the content of the charge controlling agent is typically from 0.1 to 10 parts by weight, and preferably from 0.2 to 5 parts by weight, per 100 parts by weight of the binder resin included in the toner. The content of the charge controlling agent includes all values and subvalues therebetween, particularly including 0. 5, 1, 1.5, 2, 2.5, 3, 3.5, 4, 4.5, 5, 5.5, 6, 6.5, 7, 7.5, 8, 8.5, 9 and 9.5 parts by weight. When the content is too high, the toner has too large a charge quantity, and thereby the electrostatic force of a developing roller attracting the toner increases, resulting in deterioration of the fluidity of the toner and image density of the toner images.

External Additive

The toner of the present invention preferably includes an external additive to improve fluidity, developability and chargeability thereof. As the external additive, particulate inorganic materials are preferably used. The particulate inorganic material preferably has a primary particle diameter of from 5 nm to 2 μm, and more preferably from 5 nm to 500 nm. The primary particle diameter includes all values and subvalues therebetween, particularly including 10, 20, 30, 40, 50, 100, 150, 200, 300, 400, 500, 600, 700, 800, 900 nm, 1 μm, 1.1, 1.2, 1.3, 1.4, 1.5, 1.6, 1.7, 1.8 and 1.9 μm. The specific surface area determined by the BET method is preferably from 20 to 500 $m^2/g$. The BET specific surface area includes all values and subvalues therebetween, particularly including 50, 100, 150, 200, 250, 300, 350, 400 and 450 $m^2/g$. The toner preferably includes the particulate inorganic material in an amount of from 0.01 to 5.0% by weight, and more preferably from 0.01 to 2.0% by weight. The amount of the particulate inorganic material includes all values and subvalues therebetween, particularly including 0.05, 1.0, 1.5, 2.0, 2.5, 3.0, 3.5, 4.0 and 4.5% by weight.

Specific examples of the particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These can be used alone or in combination.

Particulate polymers can be used as the external additive instead of or in combination with the particulate inorganic materials. Specific examples of the particulate polymers include particulate polymers which are prepared by a polymerization method such as soap-free emulsionpolymerization methods, suspension polymerization methods and dispersion polymerization methods (e.g., polystyrene, polymethacrylates, polyacrylate copolymers, etc.); and particulate polymers which are prepared by a polymerization method such as polycondensation methods (e.g., silicone, benzoguanamine, nylon, etc.).

These external additives can be treated with a surface treatment agent to improve hydrophobicity thereof. A toner including hydrophobized external additive has good fluidity and chargeability even under high humidity. Specific examples of the surface treatment agents include silane coupling agent, silylation agent, silane coupling agent having an alkyl fluoride group, organictitanate coupling agent, aluminum coupling agent, silicone oil, modified silicone oil, etc. These can be used alone or in combination.

The toner of the present invention can optionally include a cleanability improving agent so as to sufficiently remove residual toner particles on the photoreceptor or the primary transfer member after the transfer process. Specific examples of the cleanability improving agents include metal salts of fatty acids such as zinc stearate and calcium stearate; particulate polymers which are prepared by a polymerization method (such as soap-free emulsion polymerization methods) such as polymethyl methacrylate and polystyrene. The particulate polymer preferably has a narrow particle diameter distribution, and has a volume average particle diameter of from 0.01 to 1 nm. The volume average particle diameter includes all values and subvalues therebetween, particularly including 0.05, 0.1, 0.2, 0.3, 0.4, 0.5, 0.6, 0.7, 0.8 and 0.9 nm.

Average Circularity

The toner of the present invention preferably has an average circularity of from 0.960 to 0.985, and more preferably from 0.960 to 0.980. It is much more preferable that the toner has an average circularity of from 0.960 to 0.975, and includes toner particles having a circularity of less than 0.94 in an amount of not larger than 15%. Such a toner can produce high definition images.

The circularity of a particle is determined by the following equation:

$$C=Lo/L$$

wherein C represents the circularity, Lo represents the length of the circumference of a circle having the same area as that of the image of the particle and L represents the peripheral length of the image of the particle. The circularity indicates the irregularity of the toner particle. When the toner is completely spherical, C is 1.00. When the toner shape becomes more complex, the circularity decreases.

Particle Diameter

The toner of the present invention preferably has a volume average particle diameter (Dv) of from 3 to 8 μm. The volume average particle diameter (Dv) includes all values and subvalues therebetween, particularly including 3.5, 4, 4.5, 5, 5.5, 6, 6.5, 7 and 7.5 μm. In addition, the toner preferably has a particle diameter distribution (Dv/Dn) (i.e., a ratio between the volume average particle diameter (Dv) and a number average particle diameter (Dn)) of from 1.00 to 1.25, and more preferably from 1.00 to 1.20. The particle diameter distribution (Dv/Dn) includes all values and subvalues therebetween, particularly including 1.05, 1.10, 1.15 and 1.20.

When such a toner is used in a two-component developer, the toner included in the developer has a stable particle diameter even if toner particle replacement is repeatedly performed in the developing device. Therefore, the toner stably has good developability for a long period of the time.

When such a toner is used in a one-component developer, in addition to the above-mentioned advantages, the toner hardly adheres to the image forming components (such as a developing roller and a toner layer thickness controlling member). As a result, the toner stably has good developability and produces high quality images for a long period of the time.

In general, as the particle diameter of the toner decreases, the produced image quality increases, but transferability and cleanability of the toner decreases. When the volume average particle diameter is too small, the toner tends to be fused on the surface of the carrier by application of a mechanical stress by agitation in the developing unit (when the toner is used in a two-component developer) or the image forming components such as a developing roller and a toner layer thickness controlling member (when the toner is used in a one-component developer). When the volume average particle diameter is too large, high definition and high quality images are hardly produced. In addition, the toner included in the developer can not have a stable particle diameter after toner particle replacement is repeatedly performed in the developing device. The same phenomena tend to occur when the particle diameter distribution is larger than 1.25.

Two-Component Developer

The toner of the present invention can be used in a two-component developer by mixing with a magnetic carrier. The two-component developer preferably includes the toner in an amount of from 1 to 10 parts by weight based on 100 parts by weight of the carrier. All known carriers having a particle diameter of from 20 to 200 μm can be used. Specific examples of the carrier include iron powder, ferrite powder, magnetite powder, magnetic resin carrier, etc.

The carrier preferably has a cover layer including a resin. Specific examples of the resins include amino resins such as urea-formaldehyde resins, melamine resins, benzoguanamine resins, urea resins, polyamide resins, epoxy resins; polyvinyl and polyvinylidene resins such as acrylic resins, polymethyl methacrylate resins, polyacrylonitrile resins, polyvinyl acetate resins, polyvinyl alcohol resins, polyvinyl butyral resins; polystyrene resins such as polystyrene resins and styrene-acrylic acid copolymer reins; halogenated olefin resins such as polyvinyl chloride; polyester resins such as polyethylene terephtalate resins and polybutylene terephthalate resins; and polycarbonate resins, polyethylene resins, polyvinyl fluoride resins, polyvinylidene fluoride resins, polytrifluoroethylene resins, polyhexafluoropropylene resins, vinylidene fluoride-acrylicmonomercopolymers, vinylidene fluoride-vinyl fluoride copolymers, fluoro terpolymers such as tetrafluoroethylene-(vinylidene fluoride)-(non-fluoride monomer) terpolymers, silicone resins, etc.

The cover layer optionally include a conductive material powder such as metal powders, carbon blacks, titanium oxides, tin oxides, zinc oxides, etc. These conductive powders preferably have an average particle diameter of not larger than 1 μm. When the average particle diameter is too large, electric resistance of the carrier is difficult to control.

Of course, the toner of the present invention can also be used as a one-component developer.

Toner Manufacturing Method

The toner of the present invention is preferably manufactured by the following method:

(1) emulsion-polymerizing monomers including at least one aromatic vinyl monomer, to prepare a particulate resin dispersion;

(2) mixing the particulate resin dispersion and a colorant (i.e., the black metallic material) dispersion to prepare an aggregation dispersion including aggregated resin particles including the colorant therein;

(3) heating the aggregation dispersion to a temperature of not less than a glass transition temperature of the particulate resin to unite each of the aggregated particles to prepare a toner dispersion; and (4) washing the toner dispersion to obtain the toner.

The toner manufactured by this method has good safety, coloring power, low temperature fixability and chargeability. In addition, this toner manufacturing method has various choices of resins, colorants, waxes, etc which can be used.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Resin Emulsion

The following components are mixed to prepare a monomer mixture.

| | |
|---|---|
| Styrene monomer | 71 parts |
| n-Butyl acrylate | 25 parts |
| Acrylic acid | 4 parts |

The following components are mixed to prepare an aqueous solution mixture.

| | |
|---|---|
| Water | 100 parts |
| Nonionic emulsifier (EMULGEN 950 from Kao Corporation) | 1 part |
| Anionic emulsifier (NEOGEN SC-A from Dai-ichi Kogyo Seiyaku Co., Ltd.) | 1.5 parts |

The aqueous solution mixture is fed to a reactor vessel and heated to 70° C. under agitation, and the monomer mixture and 5 parts of a 1% aqueous solution of potassium persulfate are respectively dropped thereto taking 4 hours. The mixture is heated for 2 hours at 70° C. to polymerize the monomers. Thus, a resin emulsion including 50% of the resin on a solid basis is prepared.

Preparation of Toner Particles

The following components are agitated using a dispersing machine T.K. HOMO DISPER Model 2.5 from PRIMIX Corporation for 2 hours at 25° C.

| | |
|---|---|
| Metallic material (1) | 20 parts |
| Charge controlling agent (BONTRON ® E-84 from Orient Chemical Industries Co., Ltd.) | 1 part |
| Anionic emulsifier (NEOGEN SC-A from Dai-ichi Kogyo Seiyaku Co., Ltd.) | 0.5 parts |
| Water | 310 parts |

Then 188 parts of the resin emulsion prepared above is added thereto, and the thus prepared mixture is heated to 60° C. after 2 hours of agitation. Then pH of the mixture is controlled to 7.0 by adding an aqueous solution of ammonium. The mixture is heated to 90° C. for 2 hours. Thus, a dispersion (1) is prepared.

One hundred (100) parts of the dispersion (1) is filtered under a reduced pressure.

The thus obtained wet cake is mixed with 100 parts of ion-exchange water and the mixture is agitated for 10 minutes with a TK HOMOMIXER at a revolution of 12,000 rpm, followed by filtering. Thus, a wet cake (1) is prepared.

The wet cake (1) is mixed with 100 parts of a 10% aqueous solution of hydrochloric acid to control the pH to 2.8. Then the mixture is agitated for 10 minutes with a TK HOMOMIXER at a revolution of 12,000 rpm, followed by filtering. Thus, a wet cake (2) is prepared.

The wet cake (2) is mixed with 300 parts of ion-exchange water and the mixture is agitated for 10 minutes with a TK HOMOMIXER at a revolution of 12,000 rpm, followed by filtering. This washing operation is performed twice. Thus, a wet cake (3) is prepared.

The wet cake (3) is dried for 48 hours at 45° C. using a circulating air drier, followed by sieving with a screen having openings of 75 μm. Thus, mother toner particles (1) having a volume average particle diameter of 5.9 μm are prepared.

One hundred (100) parts of the mother toner particles (1) are mixed with 0.5 parts of a hydrophobized silica (R972 from Nippon Aerosil Co., Ltd., having an average particle diameter of 0.016 μm) by a mixer. Thus, a toner (1) is prepared.

Example 2

The procedure for preparation of the toner (1) in Example 1 is repeated except the metallic material (1) is replaced with a metallic material (2). Thus, a toner (2) is prepared.

Example 3

The procedure for preparation of the toner (1) in Example 1 is repeated except the metallic material (1) is replaced with a metallic material (3). Thus, a toner (3) is prepared.

Example 4

The procedure for preparation of the toner (1) in Example 1 is repeated except the metallic material (1) is replaced with a metallic material (4). Thus, a toner (4) is prepared.

Comparative Example 1

The procedure for preparation of the toner (1) in Example 1 is repeated except the metallic material (1) is replaced with a metallic material (5). Thus, a toner (5) is prepared.

Comparative Example 2

The procedure for preparation of the toner (1) in Example 1 is repeated except that the amount of the metallic material (1) is changed from 20 parts to 60 parts. Thus, a toner (6) is prepared.

Comparative Example 3

The following components are mixed using a mixer.

| | |
|---|---|
| Polyester resin | 100 parts |
| Metallic material (1) | 20 parts |
| Charge controlling agent (BONTRON ® E-84 from Orient Chemical Industries Co., Ltd.) | 2 parts |
| Release agent (Carnauba wax) | 5 parts |

The mixture is kneaded three times with a three-roll mill, followed by cooling. Then the mixture is subjected to coarse pulverization to prepare coarse particles having a particle diameter of from 1 to 2.5mm, and the coarse particles are subjected to fine pulverization with an air jet pulverizer. The pulverized particles are classified. Thus, mother toner particles (7) having a volume average particle diameter of 7 μm are prepared.

One hundred (100) parts of the mother toner particles (7) are mixed with 0.5 parts of a hydrophobized silica (R972 from Nippon Aerosil Co., Ltd., having an average particle diameter of 0.016 μm) by a mixer. Thus, a toner (7) is prepared.

The properties of each of the metallic materials are shown in Table 1.

TABLE 1

| Metallic material | Metal species | Saturated magnetization (emu/g) | L* | a* | b* | Content of Ti (% by weight) | True specific gravity (g/cm$^3$) | BET specific surface area (m$^2$/g) |
|---|---|---|---|---|---|---|---|---|
| (1) | Fe, Ti | 20 | 13 | −0.5 | 0.6 | 20 | 4.1 | 14 |
| (2) | Fe, Ti | 13 | 10 | 1.8 | 2.0 | 50 | 4.7 | 18 |
| (3) | Fe, Ti | 19 | 14 | 1.4 | 1.0 | 22 | 4.3 | 0.8 |
| (4) | Fe, Ti | 25 | 10 | 0.8 | 0.9 | 30 | 4.1 | 22 |
| (5) | Fe | 53 | 21 | 11 | 10 | 0 | 4.8 | 17 |

Measurement Methods

<Average Circularity>

The average circularity of a toner can be determined using a flow-type particle image analyzer FPIA-2100 manufactured by Sysmex Corp. and an analysis software FPIA-2100 Data Processing Program for FPIA version 00-10.

Specifically, the method is as follows:

(1) 0.1 g to 0.5 g of a sample to be measured is mixed with 80 ml of ion-exchange water which includes 0.1 ml to 0.5 ml of a 10% by weight of aqueous solution of a dispersant (i.e., a surfactant) such as an alkylbenzene sulfonic acid salt NEOGEN SC-A from Dai-ichi Kogyo Seiyaku Co., Ltd;

(2) the mixture is dispersed using an ultrasonic dispersing machine (W-113MK-II from Honda Electronics Co., Ltd.) for 3 minutes to prepare a suspension including particles of 5,000 to 15,000 per micro-liter of the suspension; and (3) the average circularity and circularity distribution of the sample in the suspension are determined by the measuring instrument mentioned above.

It is important that the suspension includes toner particles of from 5,000 to 15,000 per micro-liter. This toner particle concentration can be controlled by changing the amount of the dispersant and the toner included in the suspension. The needed amount of the dispersant depends on hydrophobicity of the toner. When the amount of the dispersant is too large, bubbles are formed in the suspension, resulting in background noise of the measurement. When the amount of the dispersant is too small, toner particles cannot sufficiently get wet, resulting in deterioration of dispersibility. On the other hand, the needed amount of the toner depends on the particle diameter thereof. As the particle diameter decreases, the needed amount of the toner decreases. When the toner has a particle diameter of from 3 to 7 μm, it is preferable to add from 0.1 to 0.5 g of the toner so as to prepare a suspension including toner particles of 5, 000 to 15,000 per micro-liter of the suspension.

<Particle Diameter of Toner>

The volume average particle diameter (Dv), number average particle diameter (Dn) and particle diameter distribution of a toner can be measured using an instrument COULTER MULTISIZER III from Coulter Electrons Inc. and an analysis software Beckman Coulter Multisizer 3 Version 3.51.

The measuring method is as follows:

(1) 0.5 ml of a 10% by weight of aqueous solution of a surfactant (i.e., an alkylbenzene sulfonic acid salt NEOGEN SC-A from Dai-ichi Kogyo Seiyaku Co., Ltd) is included as a dispersant in 80 ml of the electrolyte (i.e., 1% NaCl aqueous solution including a first grade sodium chloride such as ISOTON-II from Coulter Electrons Inc.);

(2) 0.5 g of a toner is added in the electrolyte and the toner is dispersed by an ultrasonic dispersing machine (W-113MK-II from Honda Electronics Co., Ltd.) for 10 minutes to prepare a toner dispersion liquid;

(3) a volume and a number of the toner particles is measured by COULTER MULTISIZER III using an aperture of 100 μm to determine volume and number distribution of from 2 to 40 μm thereof, by adding the toner dispersion liquid so that the instrument indicates a toner concentration of from 6 to 10%; and (4) the volume particle diameter (Dv) and the weight average particle diameter (Dn) is determined.

It is important that the measurement toner concentration is from 6 to 10% from the view point of reproducibility of the measurement.

<Average Primary Particle Diameter of Black Metallic Material>

The average primary particle diameter of a black metallic material is determined by measuring an image obtained using a transmission electron microscope H-9000 from Hitachi, Ltd.

<Magnetic Property>

Magnet properties of a black metallic material are measured using a magnetization measurement device BHU-60 from Riken Denshi, Co., Ltd.

A sample is fed in a cell having an inner diameter of 7 mm and a height of 10 mm. The magnetic field is applied to the cell containing the sample up to 10 kOe. Saturated magnetization, residual magnetization and coercivity of the sample are determined by a measurement curve.

<Powder X-ray Diffractometry>

Whether a black metallic material includes a solid solution of $Fe_2O_3$—$FeTiO_3$ is determined by subjecting the a black metallic material to a powder X-ray diffractometry under the following conditions.

Instrument used: RINT 1100 from Rigaku Corporation

X-ray tube: Cu

X-ray tube voltage: 50 kV

X-ray tube current: 30 mA

Goniometer: wide-angle goniometer

<L*a*b* Values>

The L*, a* and b* values of a black metallic material are determined by measuring a test piece of the black metallic material using X-RITE938from X-rite. The test piece is prepared by the following method:

(1) 0.5 g of a black metallic material and 1.0 cc of a castor oil are kneaded using a Hoover muller to prepare a paste;

(2) 4.5 g of a clear lacquer is added to the paste, and the mixture is kneaded to prepare a paint; and (3) The paint is applied to a cast-coated paper using a 6 mil applicator.

Thus, the test piece is prepared.

<BET Specific Surface Area>

The specific surface area of a black metallic material is determined by a BET multipoint method by adsorbing a nitrogen gas, using a micromeritics automatic surface area analyzer GEMINI 2360 from Shimadzu Corporation.

<True Specific Gravity>

The true specific gravity of a black metallic material is measured using an air comparison pycnometer 930 from Beckman Instruments Inc.

Toner Evaluation Methods (1) Transferability

A toner is set in a copier. When the toner is transferred onto a transfer paper, the copier is stopped to operate, and residual toner particles on a photo receptor are visually observed. Transferablity is graded as follows:

◎: Residual toner particles are hardly observed. Very good.

○: A few residual toner particles are observed. Good.

Δ: The amount of observed residual toner is as same as that of conventional toner. Acceptable.

×: A large amount of residual toner is observed. Bad.

(4) Fixability

A fixing device which applies a fixing pressure of $0.7\times10^5$ Pa·s is set to a copier IMAGIO MF6550 (from Ricoh Co., Ltd.). A toner is set in the copier, and fixed images are produced while changing the temperature of the heater.

A mending tape (from 3M) is adhered to the fixed image followed by application of a predetermined pressure. After peeling off the mending tape, image density of the image is measured using a Macbeth densitometer. A fixing ratio (r) is determined by the following equation:

$$r=I_A/I_B\times100$$

wherein $I_A$ represents an image density of the image after peeling off the tape, and $I_B$ represents an image density of the image before adhering the tape.

A fixing temperature is determined by producing images while changing the temperature of the fixing roller, and measuring the fixing ratio of each of the produced images. The fixing temperature is a temperature at which the fixing ratio is not larger than 80%.

Fixability is graded as follows:

○: The fixing temperature is not larger than 129° C.

Δ: The fixing temperature is from 130 to 150° C.

×: The fixing temperature is not less than 151° C.

The properties and evaluation results of each of the toner are shown in Table 2.

TABLE 2

| | Average circularity | Weight average particle diameter (μm) | Particle diameter distribution | Transferability | Image density | Fog | Fixability |
|---|---|---|---|---|---|---|---|
| Ex. 1 | 0.983 | 4.9 | 1.05 | ◎ | 1.55 | ◎ | ○ |
| Ex. 2 | 0.980 | 5.3 | 1.09 | ◎ | 1.48 | ◎ | ○ |
| Ex. 3 | 0.977 | 5.6 | 1.07 | ○ | 1.51 | ◎ | ○ |
| Ex. 4 | 0.979 | 5.1 | 1.11 | ○ | 1.49 | ○ | ○ |
| Comp. Ex. 1 | 0.981 | 4.9 | 1.14 | X | 1.11 | ○ | Δ |
| Comp. Ex. 2 | 0.972 | 5.5 | 1.29 | X | 0.92 | X | X |
| Comp. Ex. 3 | 0.963 | 7.1 | 1.31 | X | 1.05 | X | X |

(2) Image Density

A toner is set in a copier, and a solid image is produced. The image density of the produced solid image is determined by calculating average image density values which are measured at randomly selected 5 portions of the solid image using X-RITE 938from X-rite. A toner which can produce an image having image density of not less than 1.4 can be practically used.

(3) Fog

A toner is set in a copier. When a white solid image is developed, the copier operation is stopped, and residual toner particles on a photoreceptor are transferred onto a transparent tape. Image densities of the transparent tape having toner particles thereon and an initial tape are measured using X-RITE 938 from X-rite. A difference between image densities of these tapes are graded as follows:

◎: less than 0.1 (very good)

○: not less than 0.1 and less than 0.15 (good)

Δ: not less than 0.15 and less than 0.25 (acceptable)

×: not less than 0.25 (bad)

This document claims priority and contains subject matter related to Japanese Patent Application No. 2005-136073, filed on May 9, 2005, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner manufacturing method, comprising:

emulsion-polymerizing monomers comprising an aromatic vinyl monomer, to prepare a particulate resin dispersion;

mixing the particulate resin dispersion and a colorant dispersion comprising a black metallic material, to prepare an aggregation dispersion comprising aggregated resin particles including the colorant therein;

heating the aggregation dispersion to a temperature of not less than a glass transition temperature of the particulate resin to unite each of the aggregated particles to prepare a toner dispersion; and washing the toner dispersion to obtain the toner, wherein the toner has an average circularity of from 0.960 to 0.985.

2. A toner, comprising:

a binder resin comprising aggregated resin particles; and a black metallic material, wherein the toner is manufactured by the toner manufacturing method according to claim 1.

3. The toner according to claim 2, wherein the black metallic material has a saturated magnetization of not larger than 50 emu/g.

4. The toner according to claim 2, wherein the black metallic material has an L* value of not larger than 20, an a* value of from −1.0 to +1.0, and a b* value of from −1.0 to +1.0.

5. The toner according to claim 2, wherein the black metallic material is a titanium-containing iron oxide.

6. The toner according to claim 5, wherein the black metallic material comprises titanium atoms in an amount of from 10 to 45% by weight based on iron atoms.

7. The toner according to claim 2, wherein the black metallic material has a specific surface area of from 1.3 to 80 $m^2/g$.

8. The toner according to claim 2, wherein the black metallic material has a true specific gravity of from 4.0 to 5.0 $g/cm^3$.

9. The toner according to claim 2, wherein the toner comprises the black metallic material in an amount of from 10 to 50% by weight based on a total weight of the toner.

10. The toner according to claim 2, wherein the black metallic material has an average primary particle diameter of from 0.05 to 2.0 μm.

11. The toner according to claim 2, wherein the toner has a volume average particle diameter (Dv) of from 3 to 8 μm, and wherein a ratio (Dv/Dn) between the volume average particle diameter (Dv) and a number average particle diameter (Dn) is from 1.00 to 1.25.

12. The toner according to claim 2, wherein the toner has an average circularity of from 0.977 to 0.985.

13. The toner according to claim 2, wherein the toner further comprises a wax.

14. The toner according to claim 2, wherein the toner further comprises a charge controlling agent.

15. A developer, comprising a carrier and the toner according to claim 2.

16. A toner manufacturing method according to claim 1, wherein the toner has an average circularity of from 0.977 to 0.985.

* * * * *